US005974699A

United States Patent [19]

Park

[11] Patent Number: 5,974,699

[45] Date of Patent: Nov. 2, 1999

[54] HEALTHFUL SHOES

[75] Inventor: Mun-Hwan Park, Seoul, Rep. of Korea

[73] Assignee: Nanum & Bepum Co., Ltd., Seoul, Rep. of Korea

[21] Appl. No.: 09/150,053

[22] Filed: Sep. 9, 1998

[30] Foreign Application Priority Data

Jan. 26, 1998 [KR] Rep. of Korea ..... 98-6150

[51] Int. Cl.[6] ..... A43B 13/14; A43B 3/12

[52] U.S. Cl. ..... 36/103; 36/11.5; 36/25 R; 36/140

[58] Field of Search ..... 36/103, 102, 110, 36/132, 11.5, 25 R, 140, 142

[56] References Cited

U.S. PATENT DOCUMENTS

| | | |
|---|---|---|
| 4,262,433 | 4/1981 | Hagg et al. . |
| 4,372,059 | 2/1983 | Ambrose . |
| 4,642,911 | 2/1987 | Talarico, II . |
| 4,685,227 | 8/1987 | Simmons . |
| 5,212,878 | 5/1993 | Burke et al. . |
| 5,507,106 | 4/1996 | Fox . |
| 5,826,351 | 10/1998 | Tsuji . |

FOREIGN PATENT DOCUMENTS

| | | |
|---|---|---|
| 4018518 | 1/1991 | Germany . |
| 4319650 | 1/1994 | Germany . |

*Primary Examiner*—Ted Kavanaugh
*Attorney, Agent, or Firm*—Perman & Green, LLP

[57] ABSTRACT

The healthful shoe includes a shoe sole having inclined front and rear cutouts respectively formed on front and rear sides of the shoe sole, a shoe upper attached to an upper portion of the shoe sole to cover a foot, and front and rear recesses respectively formed on the boundary surfaces between the front and back cutouts. The front and rear recesses formed on the front and rear cutouts can achieve a triple-time stepping to reduce the fatigue and to provide the smooth circulation of blood. Since the inside of the shoe sole has a height lower than that of the outside, a pedestrian walks with the inside of the foot sole in a lower position than the outside, so that the pedestrian's "O"-shaped legs can be corrected to "II"-shaped legs.

4 Claims, 6 Drawing Sheets

(a)

(b)

(c)

HEALTHFUL SHOES

BACKGROUND OF THE INVENTION

1. Field of the Invention

The present invention relates to a healthful shoe, of which the front and rear portions have a height lower than its middle portion, thereby dispersing and relieving the loads caused by the weight of a wearer on walking as well as promoting the circulation of blood.

2. Description of the Related Art

In general, shoes mitigate the transmission of the impact force produced from the weight of a pedestrian to the pedestrian vertebra.

An ideal walking gait, so called "a triple-time stepping", is well known that a procedure of landing is followed from a heel to toes on the ground.

A conventional shoe has a heel attached to the rear portion of a shoe sole which is formed on a flat bottom surface. The conventional shoe has several drawbacks that a load caused by the weight is concentrated on the heel on walking and transmitted to the vertebra to induce pain in a waist, shoulder, neck and the like, and toes are deformable. Also, since no triple-time stepping is achieved, the pedestrian becomes fatiguable.

In view of the matter described above, a shoe has been proposed that the rear portion of a shoe sole has a height lower than that of the remainder portion. This conventional shoe comprises, as shown in FIG. 1*a*, a shoe sole 10 of which the rear portion is cut to form a fat cutout 12, and a shoe upper 14 attached onto the sole 12. With the above construction, the cutout 12 is firstly touched on the ground on walking, thereby increasing a muscular strength and reforming a walking gait.

Also, as shown in FIG. 1*b*, there has been proposed another shoe having on its rear portion a curved cutout 12*a* to get out an undesired fatty portion of a calf by repeatedly applying a force to the calf on walking.

Although the above-described conventional shoes have an effect of relieving the impact force produced when the heel touches on the ground, however, the shoes have the disadvantage of easily feeling the fatigue in either walking or standing for a long time.

SUMMARY OF THE INVENTION

An object of the present invention is to overcome the foregoing and other problems encountered in connection with the conventional shoes, and to provide a healthful shoe which the fatigue felt on walking can be minimized by enabling the triple-time stepping, and the impacting loads can be dispersed and relieved by distributing the loads during the movement of the weight.

Another object of the present invention is to provide a shoe which can correct the walking gait and promote the circulation of blood.

In order to achieve the above objects, the healthful shoe according to the present invention comprises a shoe sole having inclined front and rear cutouts respectively formed on front and rear sides of the shoe sole, a shoe upper attached to the upper portion of the shoe sole to cover a foot, and front and rear recesses formed on boundary surfaces between the front and back cutouts.

According to the present invention, the front and rear recesses respectively formed on the front and rear cutouts can achieve a triple-time stepping to greatly reduce the fatigue and to improve the circulation of blood.

BRIEF DESCRIPTION OF THE DRAWINGS

The above objects, other features, and advantages of the present invention will become more apparent by describing the preferred embodiments thereof with reference to the accompanying drawings, in which.

DETAILED DESCRIPTION OF THE PREFERRED EMBODIMENTS

Figure 1A:
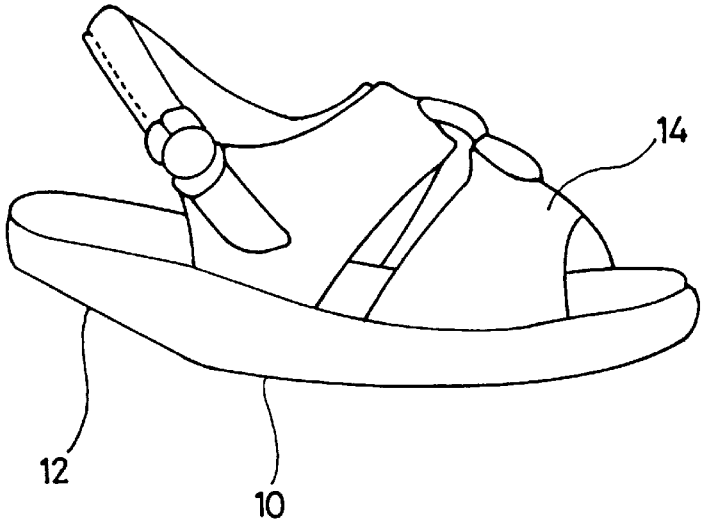
FIGS. 1*a* and 1*b* are perspective views illustrating a conventional shoe.
Figure 1B:
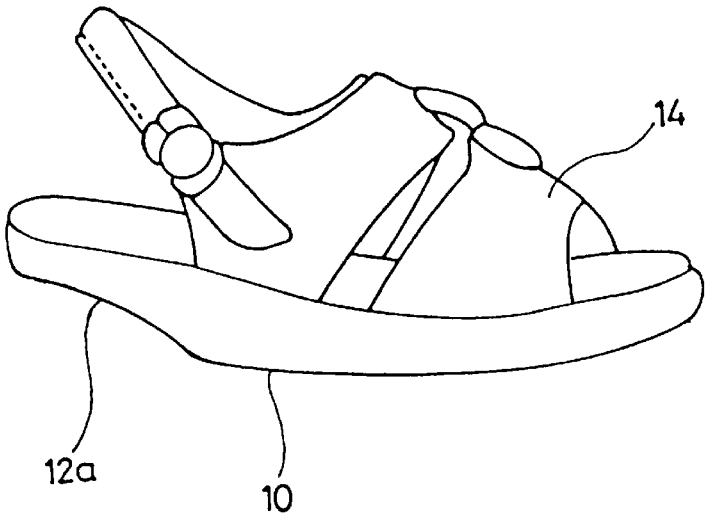
Figure 2:
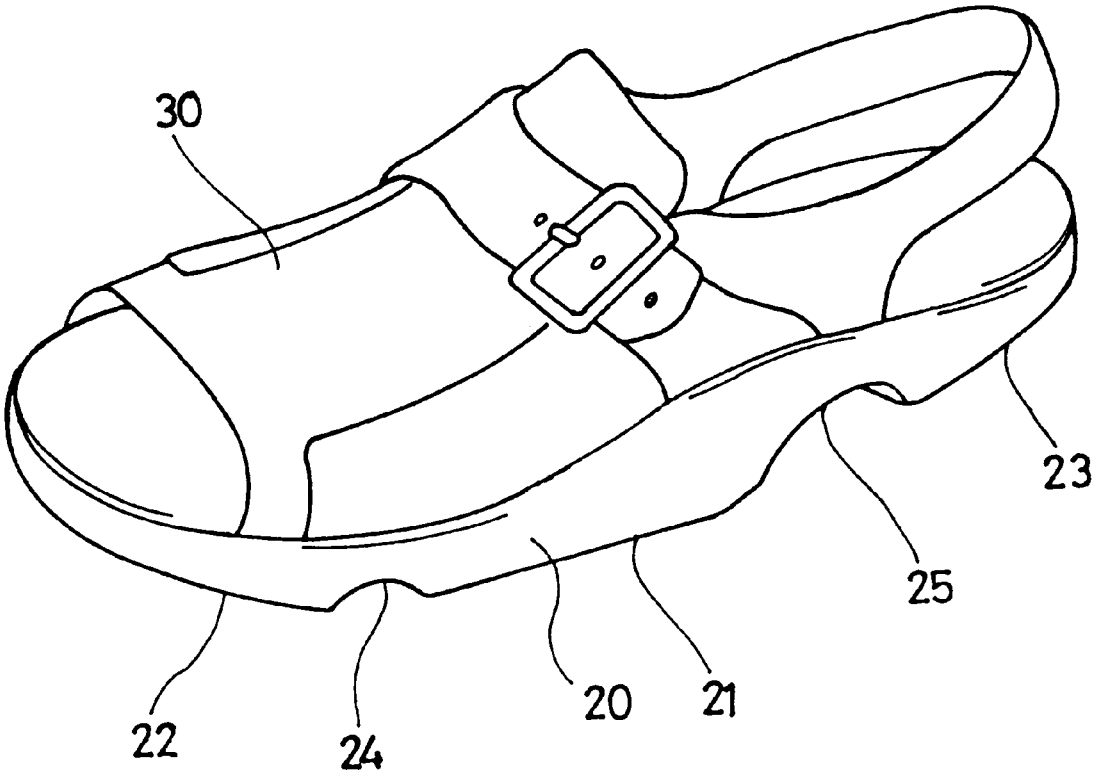
FIG. 2 is a perspective view of a shoe according to the present invention.

FIG. 2 illustrates a sandal according to the invention. Referring to FIG. 2, a shoe upper 30 is attached to the upper portion of a shoe sole 20.

Figure 3:
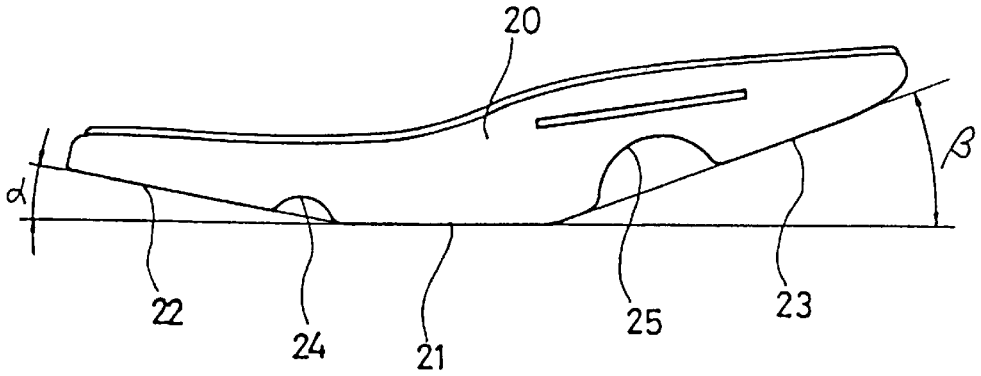
FIG. 3 is a side view of a shoe sole of FIG. 2.

The shoe sole 20, as shown in FIG. 3, has an inclined front cutout 22 formed on the front of a bottom portion 21 and an inclined rear cutout 23 formed on the rear of the bottom portion.

The inclined angle a of the front cutout 22 is in the range of about 5° to 15° relative to the bottom portion 21, and preferably about 10°. The inclined angle β of the rear cutout 23 is in the range of about 15° to 30°, and preferably about 22°. The inclined angle β of the rear cutout 23 is maintained at about 15° to make an easy landing, when the loads caused by the weight is transmitted thereto on walking.

In order to cause the shoe sole to be smoothly bent, a front recess 24 is formed on the boundary portion between the front cutout 22 and the bottom portion 21, and a rear cutout 25 is formed on the boundary portion between the rear cutout 23 and the bottom portion 21.

Preferably, the rear recess 25 has a width wider than that of the front recess 24 to increase the damping force against the loads since about 55% to 80% of the weight is transmitted to the rear cutout 23 of the shoe sole 20.

Figure 4:
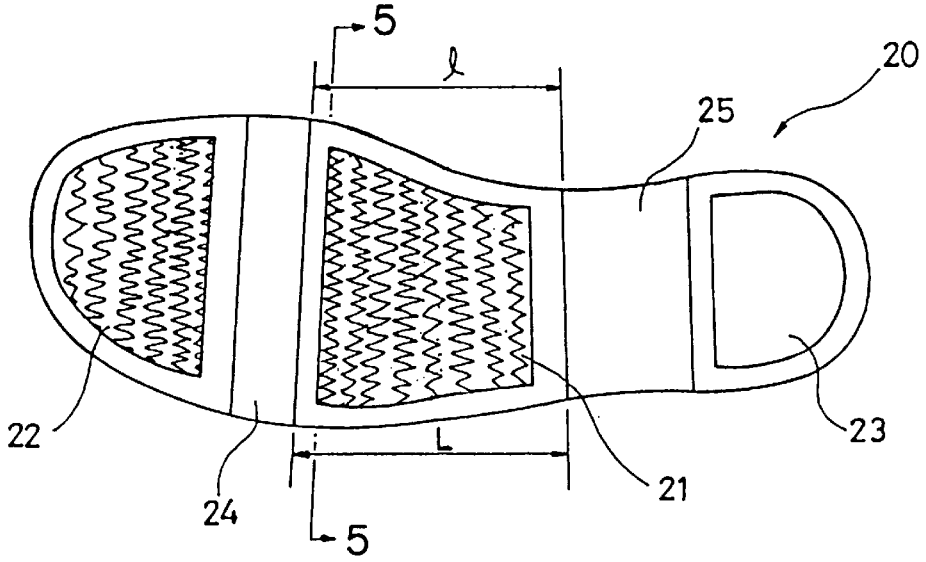
FIG. 4 is a bottom view of a shoe sole adapted to a shoe according to the present invention.

Both sides of the shoe sole 20 is formed in such a manner that the length I of an inside surface is shorter than the length L of an outside surface, as shown in FIG. 4, to prevent an out-toed gait on walking.

Figure 5:
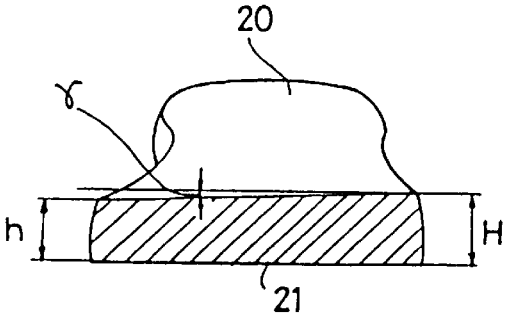
FIG. 5 is a cross sectional view taken along a line 5—5 of FIG. 4.

Also, the front portion of the shoe sole 20 is formed in such a manner that the inside thereof has a height L lower than the height H of the outside to remedy a tibia from a bent shape to a straight shape, as shown in FIG. 5. To the end, the inclined angle γ of the upper portion of the shoe sole 20 is formed in the range of about 5° to 10°, and preferably about 7°.

The shoe sole 20 is adapted to common sandals, but may be adapted to casual shoes, low shoes, sneakers, slippers, scuffles and the like, as shown in FIGS. 7 to 11.

Figure 6:
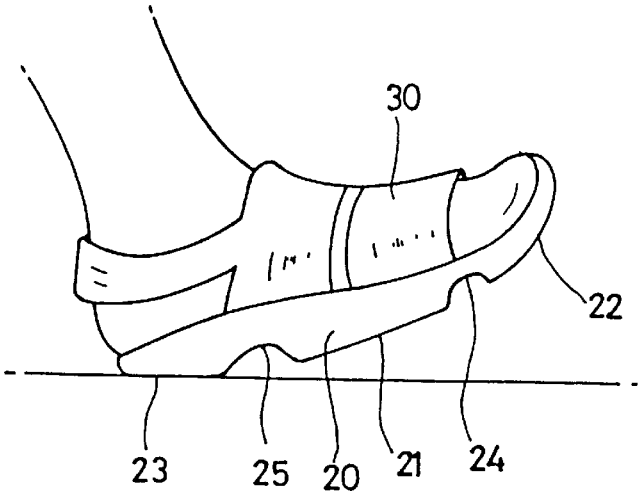
FIGS. 6*a* to 6*c* are views sequentially illustrating the triple-time stepping achieved by using a shoe according to the present invention.
Figure 6:
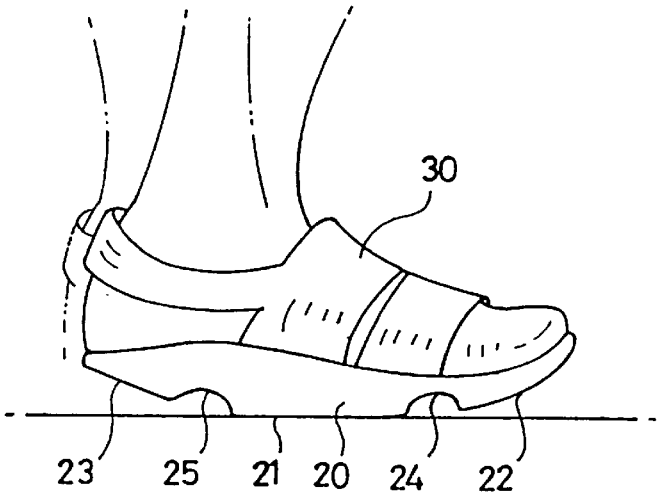
Figure 6:
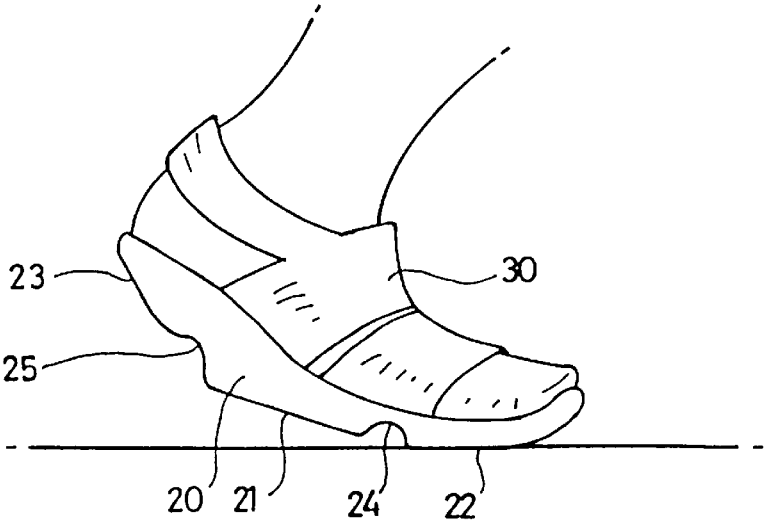
Figure 7:
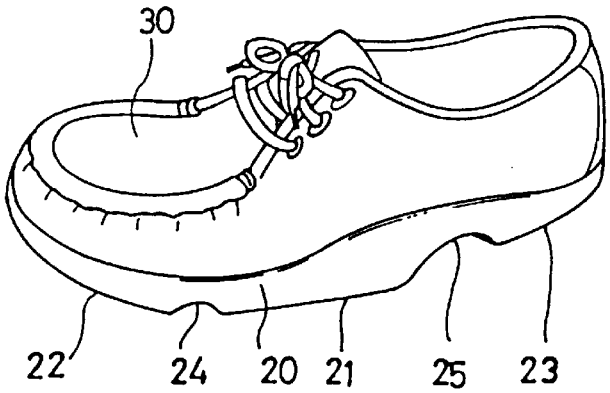
FIG. 7 is a perspective view of a casual shoe according an embodiment of the invention.
Figure 8:
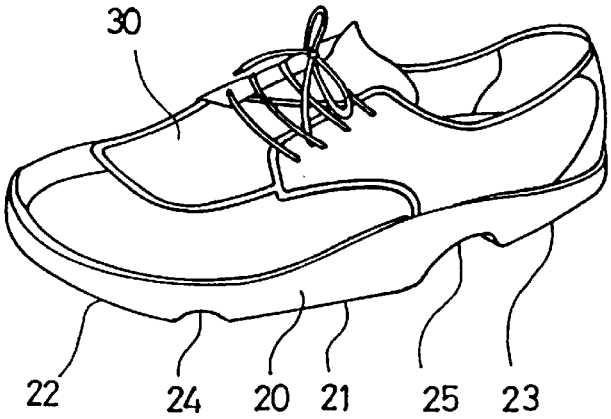
FIG. 8 is a perspective view of a low shoe according to another embodiment of the invention.
Figure 9:
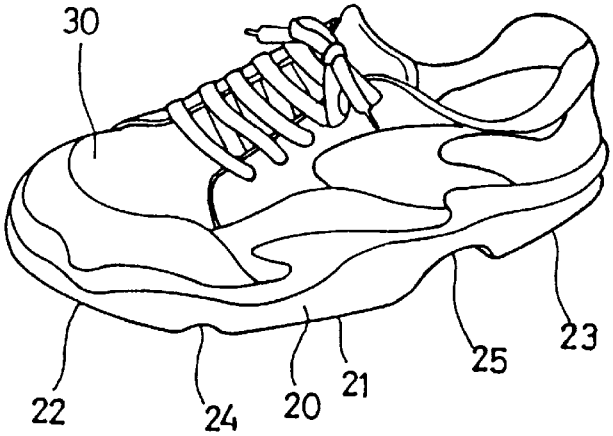
FIG. 9 is a perspective view of a sneaker according to still another embodiment of the invention.
Figure 10:
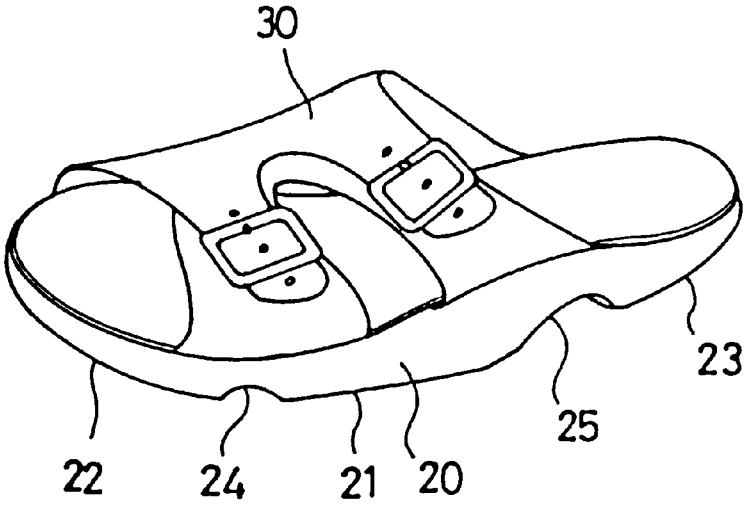
FIG. 10 is a perspective view of a slipper according to still another embodiment of the invention.
Figure 11:
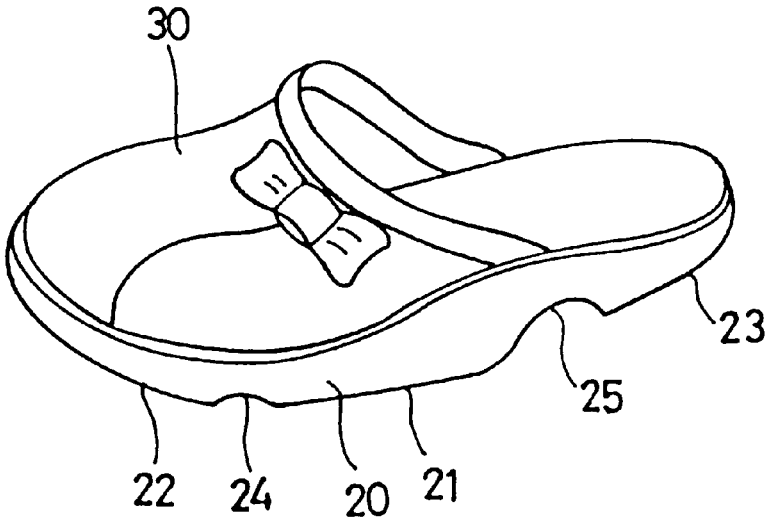
FIG. 11 is a perspective view of a scuffle according to still another embodiment of the invention.

When walking with the shoe as constructed above, the rear cutout 23 is firstly landed on the ground as shown in FIG. 6*a*.

Thereafter, if the center of the body is shifted to the middle of the shoe sole 20, the bottom portion 21 is in close contact with the ground, so that the loads caused by the weight are dispersed to the front, middle and rear portions of the shoe sole 20 to relieve transmitting of the impact force caused by the weight to the vertebra.

At this time, if a portion of the loads is transmitted to the front cutout 22, as shown in FIG. 6*b*, the front cutout 22 is deformed by the front recess 24, and the upper surface of the shoe sole 20 is bent to stimulate the spots on the foot sole which are suitable for acupuncture, so that it can assist the operation of the internal organs such as liver, kidneys and the like, and increase muscular strength by repeatedly stretching the abdominal muscle and the buttocks.

Finally, if phalanges are bent and the foot lifts up lightly, as shown in FIG. 6*c*, the front recess 24 is elastically and smoothly bent to prevent the ankylosis of toes which may cause the toes to be deformed.

The inside of the shoe sole 20 has the length I shorter than the length L of the outside, and thus if the pedestrian having an out-toed gait walks, the foot sole can be inclined inwardly at about 10° to correct the pedestrian's gate to a parallel gait.

Also, since the inside of the shoe sole 20 has the height h lower than the height H of the outside, the pedestrian walks with the inside of the foot sole being in a lower position than the outside, so that the pedestrian's "O"-shaped legs can be corrected to the "II"-shaped legs.

Further, in case of standing for a long time, since the rear cutout 23 goes down with elasticity the pedestrian can keep a straight posture, and thus the fatigue can be reduced prominently. Keeping a straight posture can prevent the disease such as umbago, arthritis, and the like, which is caused by a bad posture.

It has been verified by clinical demonstrations that if a pedestrian puts on the shoe according to the present invention, amounts of oxygen inhalation, free fatty acid, and glycerol are increased in the body in comparison to the common shoes.

While the present invention has been described and illustrated herein with reference to the preferred embodiments thereof, it will be understood by those skilled in the art that various changes in form and details may be made therein without departing from the spirit and scope of the invention.

What is claimed is:

1. A shoe comprising:

a shoe sole having an undersurface having an intermediate flat, floor-engaging portion and upwardly inclined front and rear portions of the undersurface, the front portion being inclined in the forward direction at an angle of between about 5° and 15° and the rear portion being inclined rearwardly at an angle between about 15° and 30°, both relative to said flat intermediate portion;

front and rear recesses across the width of the undersurface of the sole separating said intermediate flat portion from said front and rear portions, respectively, the rear recess being wider than the front recess;

the height of the inside edge of the intermediate flat portion of the sole being greater than the height of the outside edge portion thereof, and the length of the inside edge of the intermediate flat portion of the sole being shorter than the length of the outside edge thereof; and a shoe upper attached to an upper portion of the shoe sole for receiving the foot of a wearer.

2. A shoe according to claim 1 in which the intermediate portion tapers downwardly and inwardly from the outside edge to the inside edge thereof at an angle between about 5° and 10°.

3. A shoe according to claim 2 in which said angle is about 7°.

4. A shoe according to claim 1 in which the angle of inclination of said front portion is about 10° and the angle of inclination of said rear portion is about 22°.

* * * * *